US009091236B2

(12) United States Patent
Kajita

(10) Patent No.: US 9,091,236 B2
(45) Date of Patent: Jul. 28, 2015

(54) ENGINE DEVICE

(75) Inventor: Daisuke Kajita, Osaka (JP)

(73) Assignee: YANMAR CO., LTD., Osaka (JP)

( * ) Notice: Subject to any disclaimer, the term of this patent is extended or adjusted under 35 U.S.C. 154(b) by 489 days.

(21) Appl. No.: 13/138,081

(22) PCT Filed: Dec. 11, 2009

(86) PCT No.: PCT/JP2009/070727

§ 371 (c)(1),
(2), (4) Date: Jul. 28, 2011

(87) PCT Pub. No.: WO2010/082418

PCT Pub. Date: Jul. 22, 2010

(65) Prior Publication Data

US 2011/0277731 A1 Nov. 17, 2011

(30) Foreign Application Priority Data

Jan. 13, 2009 (JP) ..... 2009-004497

(51) Int. Cl.

| | |
|---|---|
| ***F02M 55/02*** | (2006.01) |
| ***F02F 7/00*** | (2006.01) |
| *F02M 63/02* | (2006.01) |

(52) U.S. Cl.

CPC ..... *F02M 55/025* (2013.01); *F02F 7/0068* (2013.01); *F02M 55/02* (2013.01); *F02M 63/0225* (2013.01); *F02M 2200/18* (2013.01); *F02M 2200/185* (2013.01); *F02M 2200/27* (2013.01)

(58) Field of Classification Search

CPC ..... Y10T 10/126; F02M 31/20; F02M 37/20; F02M 53/00; F02M 63/0225

USPC ..... 123/456, 447, 468, 469, 184.21, 123/184.38, 58.1, 451

See application file for complete search history.

(56) References Cited

U.S. PATENT DOCUMENTS

| | | | | |
|---|---|---|---|---|
| 5,163,406 | A * | 11/1992 | Daly et al. | 123/456 |
| 5,819,711 | A * | 10/1998 | Motose | 123/516 |
| 5,839,413 | A * | 11/1998 | Krause et al. | 123/447 |
| 6,269,804 | B1 * | 8/2001 | Braun et al. | 123/541 |

(Continued)

FOREIGN PATENT DOCUMENTS

| | | |
|---|---|---|
| CN | 12670358 | 9/2005 |
| DE | 10 2007 000 382 | 2/2008 |

(Continued)

OTHER PUBLICATIONS

131030 JP 2005-171981 Akita English Machine Translation .pdf.*

*Primary Examiner* — Erick Solis
*Assistant Examiner* — Carl Staubach
(74) *Attorney, Agent, or Firm* — Jordan and Hamburg LLP

(57) ABSTRACT

There is provided an engine device structured such that it can improve a workability for processing a common rail system, or attaching and detaching it, in spite that it is possible to reduce a damage of a common rail due to a collision. In the engine device structured such that the common rail is provided in one side of an engine block, and the common rail is arranged so as to come close to an air intake manifold, the common rail is provided in parallel obliquely below the air intake manifold, and the common rail is tilted in such an attitude that a fuel injection pipe connector arranged in an upper surface side of the common rail is directed outward and obliquely upward.

5 Claims, 7 Drawing Sheets

(56) References Cited

U.S. PATENT DOCUMENTS

| | | | | |
|---|---|---|---|---|
| 7,275,526 | B2 * | 10/2007 | Sugimoto et al. | 123/568.12 |
| 7,328,691 | B2 * | 2/2008 | Hataura et al. | 123/568.12 |
| 7,461,635 | B2 * | 12/2008 | Maegoya et al. | 123/456 |
| 7,469,681 | B2 * | 12/2008 | Hataura et al. | 123/456 |
| 2002/0152998 | A1 * | 10/2002 | Katayama et al. | 123/541 |
| 2005/0205066 | A1 | 9/2005 | Maegoya et al. | |
| 2007/0068492 | A1 | 3/2007 | Hataura et al. | |
| 2012/0037121 | A1 * | 2/2012 | Kajita et al. | 123/445 |

FOREIGN PATENT DOCUMENTS

| | | |
|---|---|---|
| EP | 11-229991 | 8/1999 |
| EP | 1 770 272 | 4/2007 |
| JP | 2005-171981 | 6/2005 |
| JP | 2005-264846 | 9/2005 |
| JP | 2007-092598 | 4/2007 |
| JP | 2008-045491 | 2/2008 |
| JP | 2008-069786 | 3/2008 |
| JP | 4074860 | 4/2008 |
| JP | 2008-208791 | 9/2008 |

* cited by examiner

ENGINE DEVICE

BACKGROUND OF THE INVENTION

The present invention relates to an engine device such as a diesel engine or the like having an exhaust gas manifold, and more particularly to an engine device which is provided with an air intake manifold, an exhaust gas manifold, a plurality of injectors for multiple cylinders, and a common rail feeding a fuel to each of the injectors.

Conventionally, there has been a technique in which a common rail is arranged just below an air intake manifold (an exhaust gas manifold), whereby it is possible to protect the common rail by the air intake manifold (the exhaust gas manifold) with respect to a drop of a tool or the like (patent document 1). Further, there has been known a technique in which a common rail is arranged just beside an air intake manifold, whereby it is possible to inhibit the common rail from being damaged by an over heat and it is possible to protect the common rail by an air intake inlet flange (refer to patent document 2).

Patent Document 1: Japanese Patent No. 4074860

Patent Document 2: Japanese Unexamined Patent Publication No. 2007-92598

In the case that the common rail is arranged just below the air intake manifold, a fuel injection pipe communicating an injector with the common rail is formed long. Accordingly, it has been troublesome to process the fuel injection pipe or carry out an attaching and detaching work. In the case that the common rail is arranged just beside the air intake manifold, the common rail is supported to an outermost side portion of the engine. Accordingly, there is a problem that it tends to be damaged by a collision in a transverse direction. In the case that the common rail is arranged just above the air intake manifold, the common rail comes too close to the injector. Accordingly, there is a problem that the fuel injection pipe can not be easily installed or the like.

SUMMARY OF THE INVENTION

An object of the present invention is to provide an engine device structured such that it can improve a workability for processing a common rail system, or attaching and detaching it, in spite that it is possible to reduce a damage of a common rail due to a collision.

In order to achieve the object mentioned above, there is provided an engine device structured such that a common rail is provided in one side of an engine block and the common rail is arranged so as to come close to an air intake manifold, wherein the common rail is provided in parallel obliquely below the air intake manifold, and the common rail is tilted in such an attitude that a fuel injection pipe connector arranged in an upper surface side of the common rail is directed outward and obliquely upward.

According to the invention there is provided an engine device wherein a fuel inlet side of the fuel injection pipe communicated with the fuel injection pipe connector is extended toward an outer side of the air intake manifold in the obliquely upward side, from the common rail.

According to the invention there is provided an engine device wherein a taper surface is formed in an angular corner portion below an outer side surface of the air intake manifold and a fuel inlet side of the fuel injection pipe is extended in parallel to the taper surface.

According to the invention there is provided an engine device further comprising a fuel filter filtrating a fuel fed to the common rail, wherein the fuel filter is arranged in one side of the cylinder block while holding the common rail therebetween.

According to the invention there is provided an engine device wherein an oil filter filtrating the engine oil is provided in one side of a cylinder block in which the cylinder head is mounted, the common rail or the fuel filter is arranged approximately at the midpoint of a total width of the cylinder block in an axial direction of a crank output shaft, and the oil filter is arranged just below the common rail or the fuel filter.

According to the invention the engine device is structured such that the common rail is provided in one side of the engine block and the common rail is arranged so as to come close to the air intake manifold, since the common rail is provided in parallel obliquely below the air intake manifold, and the common rail is tilted in such the attitude that the fuel injection pipe connector arranged in the upper surface side of the common rail is directed outward and obliquely upward, it is possible to easily execute a nut screwing operation or the like connecting the fuel injection pipe to the fuel injection pipe connector, in spite that it is possible to reduce a damage caused by a collision of the common rail or the like by the air intake manifold. It is possible to improve an assembling and disassembling workability of a piping or the like of the fuel injection pipe.

According to an invention fuel inlet side of the fuel injection pipe communicated with the fuel injection pipe connector is extended toward the outer side of the air intake manifold in the obliquely upward side, from the common rail, it is possible to shorten a piping length of the fuel injection pipe for communicating the injector and the common rail, in comparison with the conventional structure in which the common rail is provided just below the air intake manifold. It is possible to form a folding angle in the fuel inlet side of the fuel injection pipe large. It is possible to reduce a piping resistance of the fuel fed to the injector so as to improve an engine performance.

According to an invention, since the taper surface is formed in the angular corner portion below the outer side surface of the air intake manifold and the fuel inlet side of the fuel injection pipe is extended in parallel to the taper surface, it is possible to support the common rail so as to be close to the air intake manifold while interposing a predetermined space with respect to the air intake manifold. In spite that it is possible to easily attach and detach the fuel inlet side of the fuel injection pipe with respect to the common rail, it is possible to install the common rail and the fuel inlet side of the fuel injection pipe compact while being opposed to a taper surface below the outer side surface of the air intake manifold. It is possible to protect the common rail and the fuel inlet side of the fuel injection pipe.

According to an invention, since the fuel filter filtrating the fuel fed to the common rail is provided, and the fuel filter is arranged in one side of the cylinder block while holding the common rail therebetween, it is possible to protect the common rail from the collision or the like by the fuel filter. For example, in the case that a rigidity of the common rail is higher than a rigidity of the filter case of the fuel filter, the fuel filter is deformed and damaged prior to the common rail due to the collision. As a result, it is possible to reduce the deformation and damage of the common rail caused by the collision.

According to an invention, since the oil filter filtrating the engine oil is provided in one side of the cylinder block in which the cylinder head is mounted, the common rail or the fuel filter is arranged approximately at the midpoint of the total width of the cylinder block in the axial direction of the crank output shaft, and the oil filter is arranged just below the common rail or the fuel filter, it is possible to execute a maintenance work of the common rail, the fuel filter, and the oil filter from one side (the same direction) of the engine. For example, in the case that the engine is inward provided in an engine room, it is possible to easily construct the engine room as a shape which can improve a sound proofing performance of the engine, or a shape which can improve an air cooling function of a cooling fan, in spite that it is possible to form a maintenance window of the engine room as an easily workable magnitude.

DESCRIPTION OF THE PREFERRED EMBODIMENTS

Figure 1:
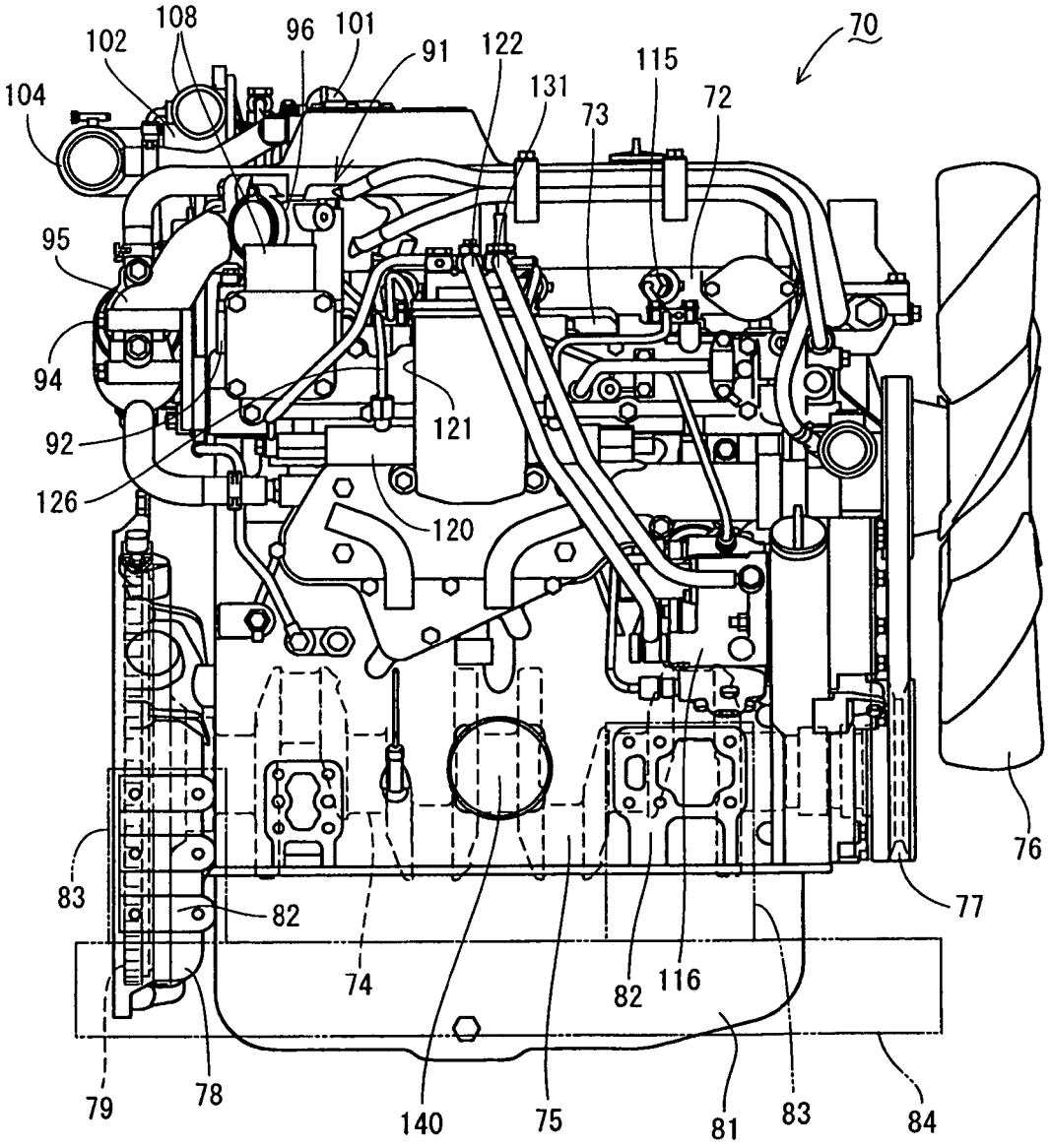
FIG. 1 is a side view in an air intake manifold installed side of a diesel engine.
Figure 2:
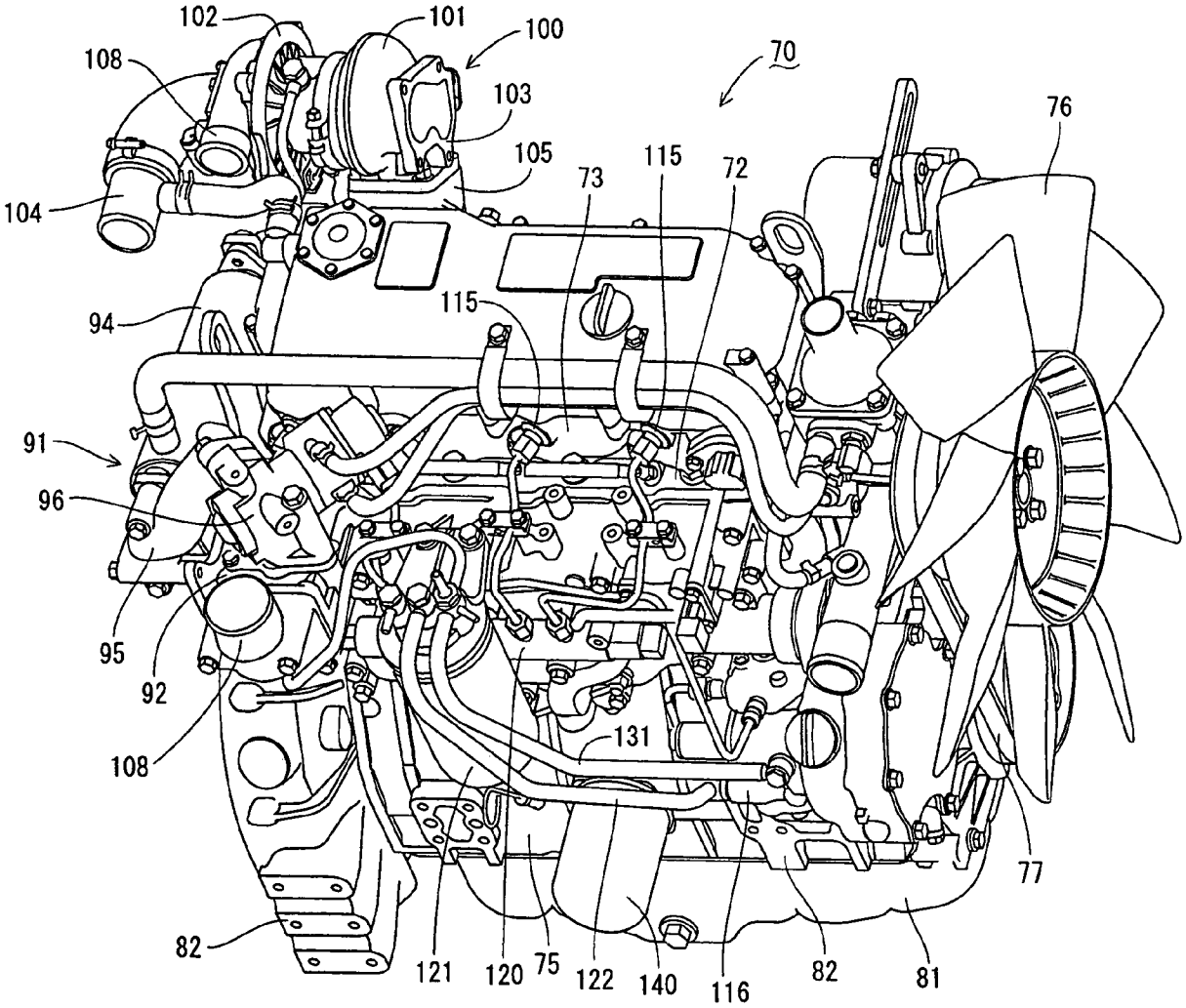
FIG. 2 is a perspective view of an outer appearance of the diesel engine.
Figure 3:
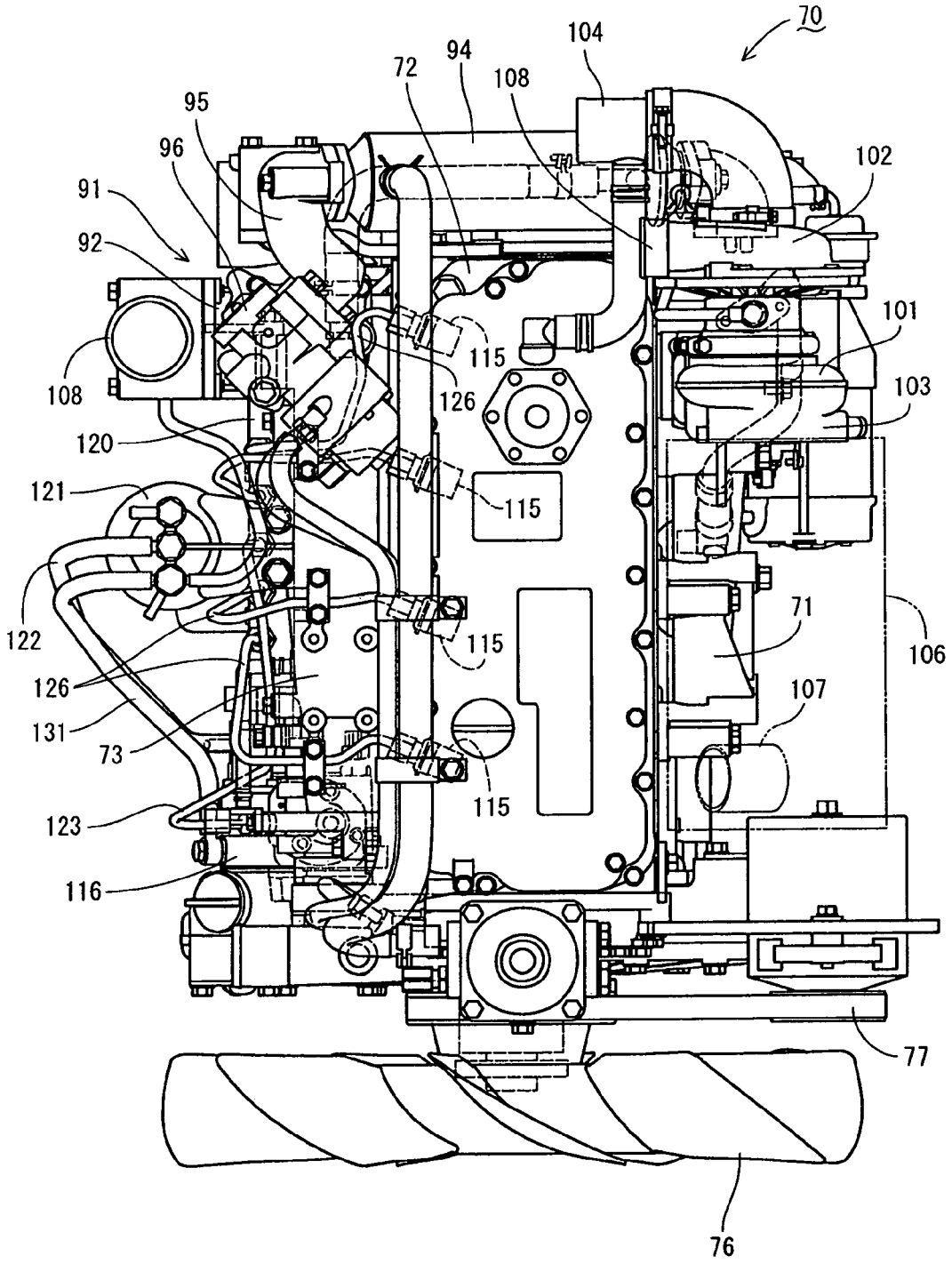
FIG. 3 is a plan view of the diesel engine.
Figure 4:
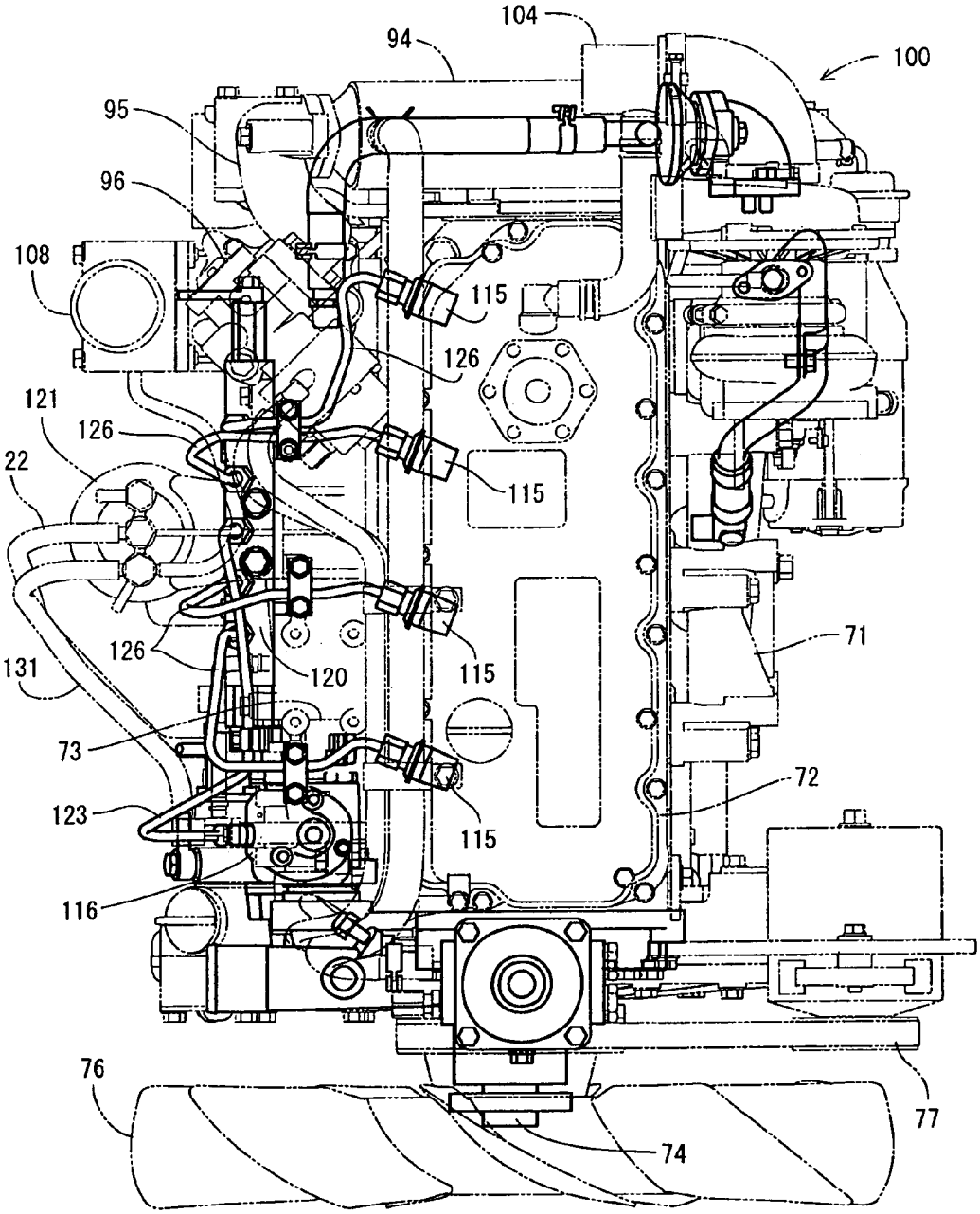
FIG. 4 is a plan explanatory view of a common rail system.
Figure 5:
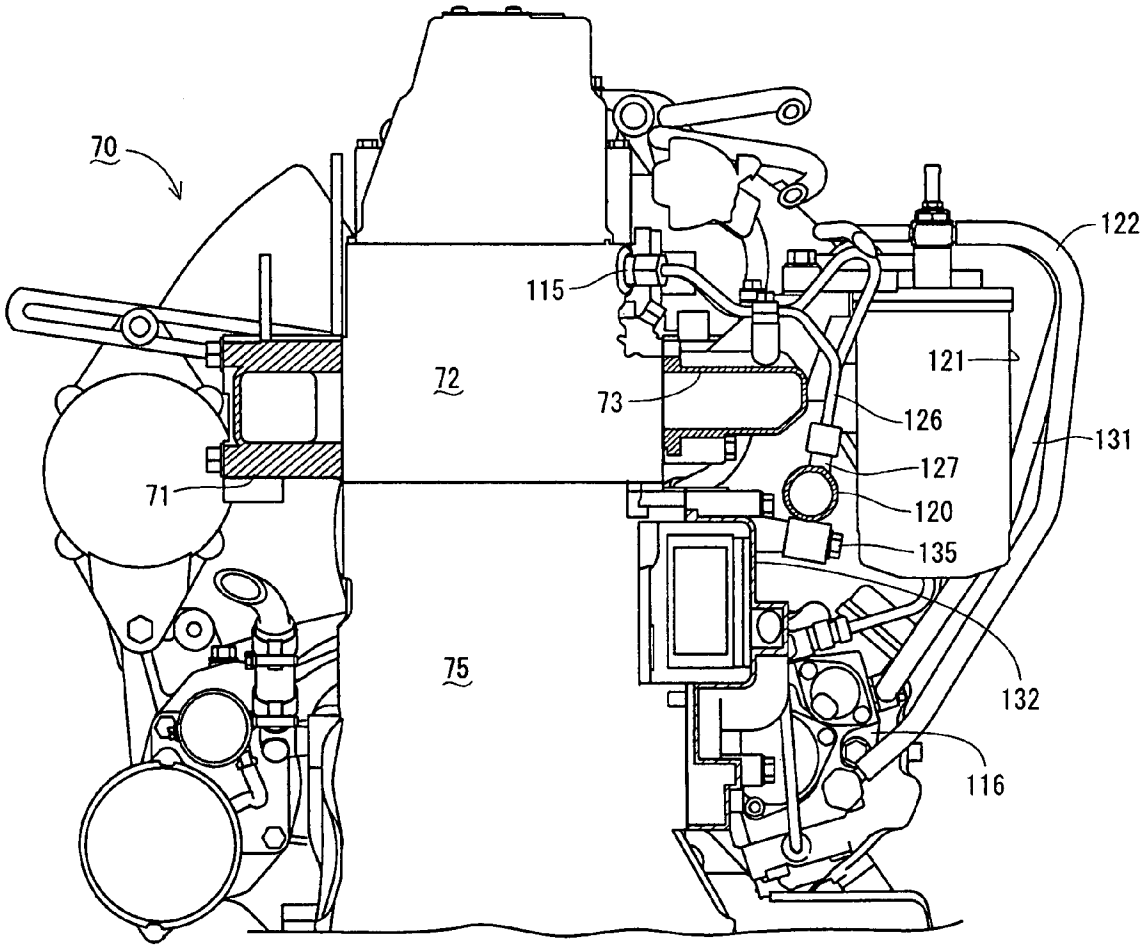
FIG. 5 is a cross sectional explanatory view of an upper side portion of the diesel engine.
Figure 6:
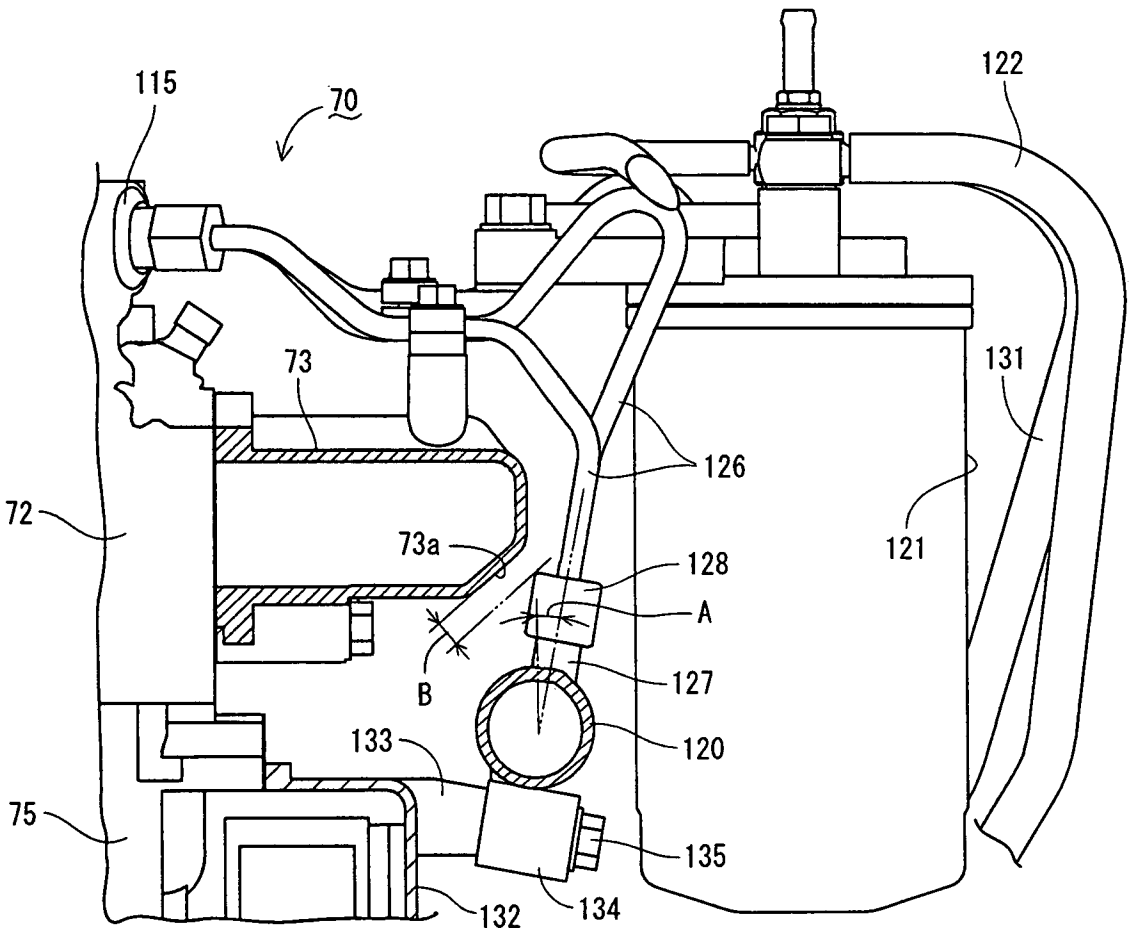
FIG. 6 is a partial enlarged cross sectional view of FIG. 5.

A description will be given below of an embodiment obtained by specifying the present invention on the basis of the accompanying drawings. FIG. 1 is a side view in an air intake manifold installed side of a diesel engine, FIG. 2 is a perspective view of an outer appearance of the engine, FIG. 3 is a plan view of the engine, FIG. 4 is a plan explanatory view of a common rail system, FIG. 5 is a cross sectional explanatory view of the common rail system, and FIG. 6 is an enlarged cross sectional view of the same. A description will be given of a whole structure of the diesel engine with reference to FIGS. 1 to 5. In this case, in the following description, an air intake manifold installed side of the diesel engine is called simply as a right side of the diesel engine, and an exhaust gas manifold installed side of the diesel engine is called simply as a left side of the diesel engine in the same manner.

A description will be given of a structure of a 4-cylinder type diesel engine 70 with reference to FIGS. 1 to 5. As shown in FIGS. 1 to 5, an exhaust gas manifold 71 is arranged in a left side surface of a cylinder head 72 of the diesel engine 70. An air intake manifold 73 is arranged in a right side surface of the cylinder head 72. The cylinder head 72 is mounted on a cylinder block 75 which has an engine output shaft 74 (a crank shaft) and a piston (not shown) built-in. A front end and a rear end of an engine output shaft 74 are protruded from a front surface and a rear surface of the cylinder block 75 respectively. A cooling fan 76 is provided in a front surface side of the cylinder block 75. It is structured such that a rotating force is transmitted to the cooling fan 76 from a front end side of the engine output shaft 74 via a V belt 77.

As shown in FIGS. 1 and 2, a flywheel housing 78 is firmly attached to a rear surface of the cylinder block 75. A flywheel 79 is provided within the flywheel housing 78. The flywheel 79 is axially supported to a rear end side of the engine output shaft 74. It is structured such that a power of the diesel engine 70 is taken out to a driving portion of a working vehicle such as a backhoe or a wheel loader which is not illustrated, via the flywheel 79.

Further, an oil pan mechanism 81 is arranged in a lower surface of the cylinder block 75. An engine leg attaching portion 82 is provided in each of right and left side surfaces of the cylinder block 75 and right and left side surfaces of the flywheel housing 78. An engine leg body 83 having a vibration proof rubber is fastened by bolt to each of the engine leg attaching portions 82. The diesel engine 70 is supported in a vibration proof manner to an engine support chassis 84 via each of the engine leg bodies 83.

As shown in FIGS. 1 to 3, an air cleaner which is not illustrated is connected to an inlet side of the air intake manifold 73 via an exhaust gas recirculation apparatus (EGR) 91. An ambient air which is removed dust and purified by the air cleaner 88 is fed to the air intake manifold 73 via the EGR apparatus 91, and is supplied to each of cylinders of the diesel engine 70.

As shown in FIGS. 1 and 2, the EGR apparatus 91 has an EGR main body case (a collector) 92 which mixes a recirculation exhaust gas of the diesel engine 70 (an EGR gas from the exhaust gas manifold 71) and a fresh air (an external air from the air cleaner) so as to supply to the air intake manifold 73, a recirculation exhaust gas pipe 95 which is connected to the exhaust gas manifold 71 via the EGR cooler 94, and an EGR valve 96 which communicates the EGR main body case 92 with the recirculation exhaust gas pipe 95.

According to the structure mentioned above, the external air is supplied into the EGR main body case 92 from the air cleaner (not shown), and the EGR gas (a part of the exhaust gas discharged from the exhaust gas manifold 71) is supplied into the EGR main body case 92 from the exhaust gas manifold 71 via the EGR valve 96. After the external air from the air cleaner (not shown) and the EGR gas from the exhaust gas manifold 71 are mixed within the EGR main body case 92, the mixed gas within the EGR main body case 92 is supplied to the air intake manifold 73. In other words, a part of the exhaust gas discharged from the diesel engine 70 to the exhaust gas manifold 71 is reflowed from the air intake manifold 73 to the diesel engine 70, whereby a maximum temperature of combustion at a time of an operation under a high load comes down, and a discharge amount of a nitrogen oxide (NOx) from the diesel engine 70 is lowered.

As shown in FIGS. 1 to 3, a turbo supercharger 100 is attached to a right side surface of the cylinder head 72. The turbo supercharger 100 has a turbine case 101 having a turbine wheel (not shown) built-in, and a compressor case 102 having a blower wheel (not shown) built-in.

The exhaust gas manifold 71 is connected to an exhaust gas intake pipe 105 of the turbine case 101. A tail pipe 107 is connected to the exhaust gas discharge pipe 103 of the turbine case 101 via a muffler 106 (or a diesel particulate filter or the like). In other words, the exhaust gas discharged to the exhaust gas manifold 71 from each of the cylinders of the diesel engine 70 is discharged to an external portion from the tail pipe 107 via the turbo supercharger 100 or the like.

On the other hand, an air supply discharge side of the air cleaner (not shown) is connected to an air supply intake side of the compressor case 102 via an air supply pipe 104. The air intake manifold 73 is connected to an air supply discharge side of the compressor case 102 via a supercharging pipe 108. In other words, the ambient air which is removed dust by the air cleaner is supplied to each of the cylinders of the diesel engine 70 from the compressor case 102 via the supercharging pipe 108.

Figure 7:
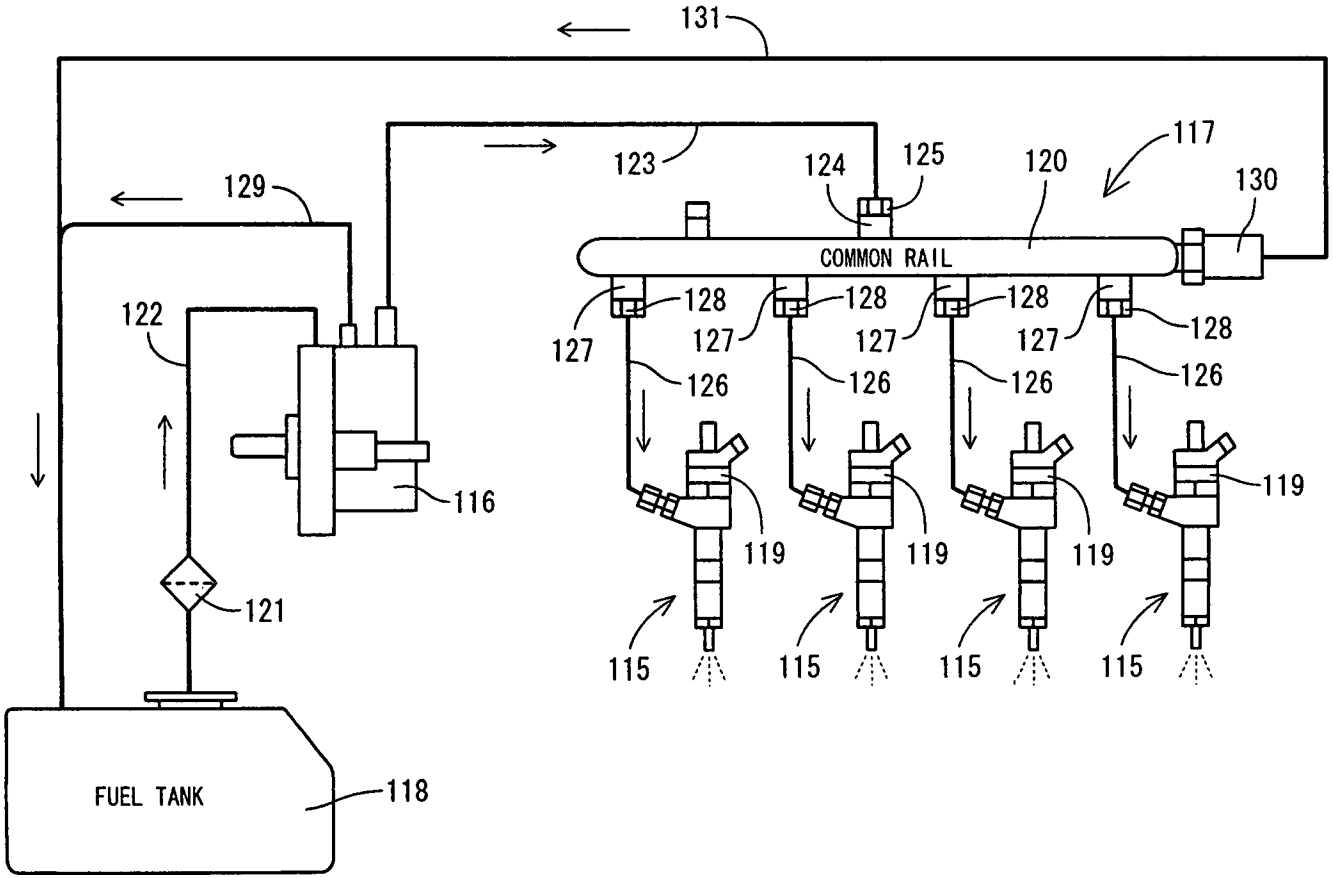
FIG. 7 is an explanatory view of a fuel system of the diesel engine.

Next, a description will be given of a common rail system 117 and a fuel system structure of the diesel engine 70 with reference to FIGS. 1 to 7. As shown in FIGS. 1, 4 and 7, a fuel tank 118 is connected to each of injectors 115 for four cylinders provided in the diesel engine 70 via the fuel pump 116 and the common rail system 117. Each of the injectors 115 has a fuel injection valve 119 of an electromagnetically open and close control type. The common rail system 117 has a cylindrical common rail 120.

As shown in FIGS. 1, 4, and 7, the fuel tank 118 is connected to an intake side of the fuel pump 116 via a fuel filter 121 and a low pressure pipe 122. The fuel within the fuel tank 118 is sucked into the fuel pump 116 via the fuel filter 121 and the lower pressure pipe 122. On the other hand, the common rail 120 is connected to a discharge side of the fuel pump 116 via a high pressure pipe 123. A high pressure pipe connector 124 is provided at the midpoint in a longitudinal direction of the cylindrical common rail 120, and an end portion of the high pressure pipe 123 is connected to the high pressure pipe connector 124 with a screw attachment of a high pressure pipe connector nut 125.

Further, the respective injectors 115 for four cylinders are connected to the common rail 120 via four fuel injection pipes 126. Fuel injection pipe connectors 127 for four cylinders are provided in a longitudinal direction of the cylindrical common rail 120, and an end portion of the fuel injection pipe 126 is connected to the fuel injection pipe connector 127 with a screw attachment of a fuel injection pipe connector nut 128.

According to the structure mentioned above, the fuel in the fuel tank 118 is pressure fed to the common rail 120 by the fuel pump 116, and the fuel having a high pressure is stored in the common rail 120. The fuel having the high pressure within the common rail 120 is injected to each of the cylinders of the diesel engine 70 from each of the injectors 115, on the basis of an open and close control of each of the fuel injection valve 119. In other words, it is possible to control at a high precision an injection pressure, an injection timing, and an injecting period (an injection amount) of the fuel supplied from each of the injectors 115, on the basis of an electronic control of each of the fuel injection valves 119. Accordingly, it is possible to reduce a nitrogen oxide (NOx) which is discharged from the diesel engine 70. It is also possible to reduce a noise and a vibration of the diesel engine 70.

In this case, the fuel pump 116 is connected to the fuel tank 118 via a fuel return pipe 129. A common rail return pipe 131 is connected to an end portion in a longitudinal direction of the cylindrical common rail 120 via a return pipe connector 130 which limits a pressure of the fuel within the common rail 120. In other words, an excess fuel of the fuel pump 116 and an excess fuel of the common rail 120 are collected in the fuel tank 118 via the fuel return pipe 129 and the common rail return pipe 131.

Further, as shown in FIGS. 1, 5, and 6, a fastening bed plate 133 is integrally formed in a cooling water housing 132 which is provided in one side of the engine block 75. Further, a fastening boss 134 is integrally formed in the common rail 120. The fastening boss 134 is firmly attached to the fastening bed plate 133 by a rail attaching bolt 135. The common rail 120 is detachably fastened to one side of the engine block 75 via the cooling water housing 132. In other words, the common rail 120 is provided in one side of the engine block 75. The common rail 120 is arranged so as to be close to the air intake manifold 73.

As shown in FIGS. 1, 5, and 6, the common rail 120 is provided in parallel obliquely below the air intake manifold 73. The common rail 120 is structured such as to be tilted to an attitude that the fuel injection pipe connector 127 which is arranged in an upper surface side of the common rail 120 is directed outward and obliquely upward. Accordingly, since a part of the upper surface side of the common rail 120 is covered by the air intake manifold 73, it is possible to reduce a damage due to a collision or the like of the common rail 120 by the air intake manifold 73 even if a tool or the like is dropped from the above toward the common rail 120 during an assembling and disassembling work of the diesel engine 70 or the like. Further, it is possible to easily execute a screw attaching operation or the like of the fuel injection pipe connector nut 128 for connecting the fuel injection pipe 126 to the fuel injection pipe connector 127. It is possible to improve an assembling and disassembling workability of a piping or the like of the fuel injection pipe 126.

As shown in FIGS. 5 and 6, a fuel inlet side of the fuel injection pipe 126 communicated with the fuel injection pipe connector 127 is extended from the common rail 120 toward an outer side of the air intake manifold 73 which is arranged in an obliquely upward side common rail 120. In other words, the fuel inlet side of the fuel injection pipe 126 is structured such that it is tilted at a predetermined angle A toward an outer side of the air intake manifold 73, with respect to a vertical line. Accordingly, the fuel inlet side of the fuel injection pipe 126 can be extended from the common rail 120 toward an obliquely upward side. The fuel inlet side of the fuel injection pipe 126 can be extended at a greater folding angle than the conventional structure from the common rail 120 toward the upward injector 115. The fuel inlet side of the fuel injection pipe 126 can be broken away sufficiently with respect to the air intake manifold 73 in such a manner that the fuel inlet side of the fuel injection pipe 126 does not come into contact with the air intake manifold 73 due to the vibration or the like of the fuel injection pipe 126.

For example, in the conventional structure in which the common rail 120 is provided just below the air intake manifold 73, it is necessary to make the fuel inlet side of the fuel injection pipe 126 extend sideways from the common rail 120 and make the fuel inlet side of the fuel injection pipe 126 be away from the air intake manifold 73. In other words, in comparison with the conventional structure, it is possible to shorten a piping length of the fuel injection pipe 126 for communicating and connecting the injector 115 and the common rail 120. Since the folding angle of the fuel injection pipe 126 in the fuel inlet side becomes larger than the conventional structure, it is possible to reduce a piping resistance of the fuel which is supplied to the injector 115, and it is possible to improve a performance of the diesel engine 70.

As shown in FIGS. 5 and 6, a taper surface 73*a* is formed in an angular corner portion below an outer side surface of the air intake manifold 73. In other words, the taper surface 73*a* is formed as a cutting surface shape obtained by cutting an angular corner portion below the outer side surface of the rectangular box shaped air intake manifold 73. The fuel inlet side of the fuel injection pipe 126 is extended in parallel to the taper surface 73*a*. The common rail 120 is assembled in an obliquely downward side of the air intake manifold 73 by moving the fuel injection pipe 126, the fuel injection pipe connector 127, or the fuel injection pipe connector nut 128 which is arranged so as to be opposed to the taper surface 73*a*, and the taper surface 73*a* close to the air intake manifold 73, while setting them be away from each other at a predetermined distance B or more.

In other words, it is possible to support the common rail 120 so as to be close to the air intake manifold 73, while interposing a predetermined space (the predetermined distance B) with respect to the air intake manifold 73. Since a spanner can be easily handled by forming the space (the distance B), and a screwing operation or the like of the fuel injection pipe connector nut 128 can be easily executed, it is possible to easily attach and detach the fuel inlet side of the fuel injection pipe 126 to and from the common rail 120.

Further, it is possible to install the fuel inlet side or the like of the common rail 120 or the fuel injection pipe 126 compactly to a position which is opposed to the taper surface 73*a* below the outer side surface of the air intake manifold 73. It is possible to easily protect the fuel inlet side or the like of the common rail 120 or the fuel injection pipe 126, by the air intake manifold 73.

As shown in FIGS. 1, 5, and 6, a fuel filter 121 is structured such as to filtrate the fuel which is supplied to the common rail 120, and the fuel filter 121 is arranged in one side of the cylinder block 75 while holding the common rail 120 therebetween. Accordingly, even if an obstacle comes into collision from the side direction of the diesel engine 70, the obstacle comes into contact with the fuel filter 121 prior to the common rail 120. Accordingly, it is possible to protect the common rail 120 from the collision or the like by the fuel filter 121. For example, since it is structured such that a rigidity of the common rail 120 becomes higher than a rigidity of the filter case of the fuel filter 121, the fuel filter 121 deforms and damages prior to the common rail 120 on the basis of the collision of the obstacle. As a result, it is possible to reduce a deformation and damage of the common rail 120 due to the collision of the obstacle.

As shown in FIGS. 1, 5, and 6, an oil filter 140 filtrating an engine oil of the diesel engine 70 is provided in one side of the cylinder block 75 on which the cylinder head 72 is mounted. The oil filter 140 is arranged approximately at the midpoint of a total width of the cylinder block 75 in an axial direction of the crank type engine output shaft 74. Further, the common rail 120 or the fuel filter 121 is arranged approximately at the midpoint of the total width of the cylinder block 75 in the axial direction of the crank type engine output shaft 74. In other words, the oil filter 140 is arranged approximately just below the common rail 120 or the fuel filter 121.

Accordingly, it is possible to execute a maintenance work of the common rail 120, the fuel filter 121, and the oil filter 140, from a left side (the same direction) of the diesel engine 70. For example, in the case that the diesel engine 70 is inward provided in the engine room (not shown), the engine room can be constructed easily as a shape which can improve a sound proofing performance of the engine 70, or a shape which can improve an air cooling function of the cooling fan 76, in spite that it is possible to form a maintenance window (not shown) of the engine room as an easily workable magnitude.

DESCRIPTION OF REFERENCE NUMERALS

70 Diesel engine
72 Cylinder head
73 Air intake manifold
73*a* Taper surface
74 Engine output shaft
75 Cylinder block
115 Injector
120 Common rail
121 Fuel filter
126 Fuel injection pipe
127 Fuel injection pipe connector
140 Oil filter

What is claimed is:

1. An engine device comprising:
an engine block;
a common rail located at one side of the engine block;
an air intake manifold; and
a fuel filter that filters a fuel fed to the common rail, the fuel filter being arranged at said one side of a cylinder block of the engine block with the common rail therebetween; and
wherein the common rail is arranged so as to come close to the air intake manifold;
wherein the common rail is provided in parallel obliquely below the air intake manifold, and the common rail is tilted in such an attitude that a connector for a fuel injection pipe is arranged in an upper surface side of the common rail is directed outward and obliquely upward;
wherein a fuel inlet side of the fuel injection pipe communicated with the fuel injection pipe connector is extended toward an outer side of the air intake manifold in an obliquely upward side, from the common rail;
wherein a taper surface is formed in an angular corner portion below an outer side surface of the air intake manifold and a fuel inlet side of the fuel injection pipe is extended in parallel to the taper surface;
wherein the fuel filter is located in a position to cover both the intake manifold and the common rail, and covers the outer side of the fuel injection pipe with the fuel filter so as to protect the common rail and fuel injection pipe from obstacles;
wherein a fastening bed is integrally formed in a cooling water housing below the common rail, which is provided on one side of the engine block, and a fastening boss, which is integrally formed in the common rail, is detachably attached to the fastening bed by a rail attaching bolt, whereby the common rail is arranged separate from said one side of the engine block.

2. The engine device according to claim 1, wherein an oil filter filtrating engine oil is provided in one side of the cylinder block in which a cylinder head is mounted, and wherein the common rail or the fuel filter is arranged approximately at a midpoint of a total width of the cylinder block in an axial direction of a crank output shaft, and the oil filter is arranged just below the common rail or the fuel filter.

3. The engine device according to claim 1, wherein the common rail is separated from said one side of the engine block with the cooling water housing and fastening bed interposed between the common rail and the engine block.

4. The engine device according to claim 1, wherein the common rail is provided in parallel below the air intake manifold at an oblique offset so as to be exposed laterally outward from the air intake manifold from a downward vertical perspective.

5. An engine device comprising:
an engine block;
a common rail located at one side of the engine block;
an air intake manifold; and
a fuel filter that filters a fuel fed to the common rail, the fuel filter being arranged at said one side of a cylinder block of the engine block with the common rail therebetween; and
wherein the common rail is arranged so as to come close to the air intake manifold;
wherein the common rail is provided in parallel obliquely below the air intake manifold, and the common rail is tilted in such an attitude that a connector for a fuel injection pipe is arranged in an upper surface side of the common rail is directed outward and obliquely upward;
wherein a fuel inlet side of the fuel injection pipe communicated with the fuel injection pipe connector is extended toward an outer side of the air intake manifold in an obliquely upward side, from the common rail;

wherein a taper surface is formed in an angular corner portion below an outer side surface of the air intake manifold and a fuel inlet side of the fuel injection pipe is extended in parallel to the taper surface;

wherein the fuel filter is located in a position to cover both the intake manifold and the common rail, and covers the outer side of the fuel injection pipe with the fuel filter;

wherein a fastening bed is integrally formed in a cooling water housing below the common rail, which is provided on one side of the engine block, and a fastening boss, which is integrally formed in the common rail, is detachably attached to the fastening bed by a rail attaching bolt, whereby the common rail is arranged separate from said one side of the engine block; and wherein the common rail is positioned relative to the air intake manifold, the fuel injection pipe is positioned relative to the common rail, and the fuel filter is positioned relative to the air intake manifold and common rail to provide a configuration that protects the common rail and the fuel injection pipe from obstacles, including so protecting the common rail and fuel injection pipe from obstacles from above by the fuel filter.

* * * * *